United States Patent [19]

Wallsten

[11] 4,288,473

[45] Sep. 8, 1981

[54] PROCESS FOR APPLYING A COATING TO BOTH SIDES OF A RUNNING PAPER WEB

[75] Inventor: Hans I. Wallsten, Lausanne, Switzerland

[73] Assignee: Inventing S.A., Switzerland

[21] Appl. No.: 32,921

[22] Filed: Apr. 24, 1979

[51] Int. Cl.[3] ..... B05D 1/00; B05D 5/00

[52] U.S. Cl. ..... 427/209

[58] Field of Search ..... 427/209

[56] References Cited

U.S. PATENT DOCUMENTS 3,489,592 1/1970 Wallsten ..... 427/209

4,076,864 2/1978 Wallsten ..... 427/209

*Primary Examiner*—Bernard D. Pianalto

*Attorney, Agent, or Firm*—Ostrolenk, Faber, Gerb & Soffen

[57] ABSTRACT

A continuous process for applying a coating to both sides of a paper web in which the web is fed at a speed of at least 400 meters per minute through the nip formed between a rotating applicator roll and an elastically yielding blade. A coating composition is fed into the sumps formed on each side of the web at the nip at a rate such that the amount of coating material applied to the web, calculated as the total of both sides of the web, exceeds 14 grams per square meter. The viscosity of the coating composition is maintained at 400 to 2000 centipoises and the web is withdrawn from the nip so that it is bent away from the applicator roll over the edge of the blade at an angle of between 8° and 12° to the tangient to the roll at the nip, thus reducing or eliminating the formation of mist downstream of the nip.

6 Claims, 4 Drawing Figures

PROCESS FOR APPLYING A COATING TO BOTH SIDES OF A RUNNING PAPER WEB

The present invention relates to a process for applying a coating to both sides of a paper web running at high speed.

In one such process, the amounts applied, calculated as the total on both sides of the paper web, exceed 14 g/m$^2$ and the paper web is pressed against a roll by means of an elastically yielding blade and is simultaneously wetted on both sides by the coating composition present in a space formed by the roll and the blade. Immediately after emerging from the nip between the blade and roll, the web is bent away from the applicator roll at an angle to the tangient in the roll nip.

Coating of paper improves the properties of the paper in various ways, for example better printing of the paper is thus made possible. For this purpose, a dispersion of the coating agent with appropriate binders and other additives is used in most cases. The extent of the improvement obtained depends on various factors; in general, it is desired to apply a defined amount of the coating composition and it is assumed in many cases that an amount applied of 10–12 g/m$^2$, calculated as dry coating composition per side, is necessary in order to manufacture a paper which is suitable, for example, for illustration purposes.

Other factors must, however, also be taken into account in coating, for example, the power consumption during the subsequent drying of the paper web. In general, a high dry solids content of the dispersion used is also desired so that, for a certain defined amount applied, a relatively low absorption of water in the base paper is obtained and a correspondingly smaller quantity of energy is necessary to remove this quantity of water after the coating process. The dry solids content of the coating composition, however, also affects the rheological properties of the coating composition, that is to say, a higher dry solids content in general gives a higher viscosity for certain given pigments and binders.

It will be evident from the above that those skilled in the art have to observe a large number of different factors in the manufacture of coated paper of good quality in order to be able to optimise the results of coating.

The known, so-called billblade process (U.S. Pat. No. 3,489,592) teaches that both sides of a paper web can be coated simultaneously in a relatively simple apparatus and relatively large amounts can be applied on both sides of the paper so that the coating obtained is uniform and the danger of forming a so-called orange-peel pattern is eliminated. In fact, the prevention of this orange-peel effect is an important pre-requisite for obtaining good printability of the paper.

According to this known process, the application of a coating on both sides is effected in such a way that the running paper web is pressed against a roll by means of an elastically yielding blade and is simultaneously charged on both sides with the coating composition and bent away from the roll. The paper web is here passed into and out of a coating composition present in a space formed, in a manner which is in itself known, by the roll and the blade in such a way that the paper web is fully wetted by the coating composition on both sides and, immediately after emerging from the nip between the blade and roll, is bent away from the applicator roll at an angle of more than 5° to the tangent in the roll nip and subjected to a drying process.

This known process made it possible, for example, to obtain a very high quality printing paper coated on both sides with a total amount applied of between 20 and 24 g/m$^2$ and with a uniform distribution on both sides of the paper, both at low speeds and at speeds of up to 400 m/minute. In this known process, the applicator roll is provided with a relatively soft rubber facing and rotates at a speed which approximately coincides with the speed of the paper web or exceeds this speed by about 5%. The blade used is a steel blade having a thickness of 0.25–0.5 mm. The coating composition is applied in the said space or sump on both sides of the paper web in fair excess, and in particular, in such a way that a quantity of coating composition flows continuously through this sump and overflows over the fork edges of the space; this overflowing coating composition is then screened and recycled to the sump, together with fresh coating composition. In practice, an angle of take-off of about 20° relative to the tangent of the applicator roll is here used.

In this known method, it is important that the paper web is taken off under a certain angle over the plate edge when it emerges from the nip between the blade and roll. This prevents the paper web from being taken along by the applicator roll after emerging from the said nip, which would immediately result in the feared effect of forming an orange-peel pattern by splitting of the film. When this known device is used at speeds of up to 400 m/minute, an angle of take-off of between 15° and 20° is used to avoid this effect.

The development of paper manufacture moving to increasingly higher manufacturing speeds and, of course, this also applies to the coating process. Irrespective of whether the coating device is fitted in a paper machine so that coating can be carried out during the manufacture of the paper, or whether separate coating units are used, there is a demand for devices which can operate at very high speeds.

It has now been found that the known billblade process cannot be used at the high speeds now required for applying the large quantities which it is desired to apply simultaneously, without running into difficulties.

Thus, when carrying out the billblade process, it has surprisingly been found that, at speeds of over 400–500 m/minute and using a coating composition of known type, an exceedingly strong mist formation occurs, this mist depositing on the machine parts of the coating equipment to such an extent that problems arise with operating faults and the continuous coating process must be interrupted. Admittedly, it is possible in various ways to eliminate these difficulties or, in any case, to mitigate them and also to obtain certain improvements if, for example, the amounts applied are kept lower by increasing the contact pressure of the blade and/or by reducing the dry solids content of the coating agent. It has thus been found possible to eliminate this mist formation at amounts applied of less than about 14 g/m$^2$.

The above indications thus make it clear that the disadvantages shown represent a very serious restriction to the possible uses of the known billblade process in those cases where amounts applied of more than 14 g/m$^2$ and also a web speed of more than 400 m/minute are required.

According to the present invention, there is now provided a process for applying a coating to both sides of a paper web, said process comprising the steps of:

(a) feeding the web at a speed of at least 400 meters per minute through the nip formed between a rotating applicator roll and an elastically yielding blade having an edge which urges the web towards the roll, whereby a first sump is formed between the paper web and the roll and a second sump is formed between the paper web and the blade;

(b) feeding a coating composition into each of said first and second sumps at a rate such that the amount of coating material applied to the web, calculated as the total of both sides of the web, exceeds 14 grams per square meter;

(c) maintaining the viscosity of the coating composition in said first and second sumps at 400 to 2000 centipoises;

and (d) withdrawing the paper web from the nip, so that it is bent away from the applicator roll over the edge of the blade at an angle of between 8° and 12° to the tangient to the roll at the nip.

Surprisingly for those skilled in the art, it has been found that this process makes it possible completely to avoid the abovementioned troublesome mist formation with amounts applied of more than 14 g/m$^2$.

BRIEF DESCRIPTION OF THE DRAWING

The invention will be more readily understood from the following description, which is given merely by way of example, reference being made to the accompanying drawings.

In the drawings.

DETAILED DESCRIPTION OF THE DRAWING

Figure 1:
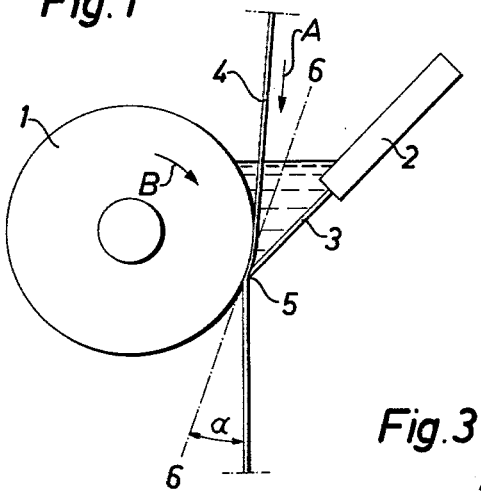
FIG. 1 is a schematic end view of a coating device used according to the known billblade coating process.

In FIG. 1, the known billblade process is illustrated and a rotating applicator roll 1 with a rubber facing is rotatable adjacent a blade holder 2 and a flexible coating blade 3 is mounted in the blade holder 2. The plate 3 presses the paper web 4—which runs in the direction of the arrow A—against the surface of the applicator roll at a contact point or nip 5. The applicator roll rotates in the direction of the arrow B. The tangient to the applicator roll 1 at the nip 5 is illustrated as a broken line and marked 6—6. The paper web 4 is drawn over the plate edge at the nip 5 at an angle $\alpha$ which is about 20° relative to the tangient 6—6.

Figure 2:
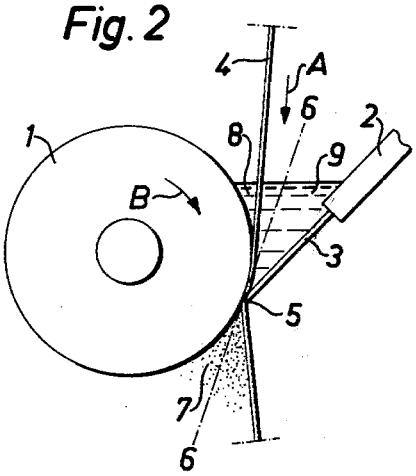
FIG. 2 shows the device illustrated in FIG. 1 when very high web speeds are used.

It has now been found that, with the procedure described in FIG. 1, the desired large amount of coating agent and the simultaneously desired uniform distribution on both sides of the paper web cannot be achieved at high web speeds. The problem which occurs is illustrated in FIG. 2 which shows coating equipment according to FIG. 1. In fact, at high web speeds and under certain conditions—which will be described in more detail below—a more or less intense formation of a mist of fine particles of coating composition is obtained downstream of the nip between the blade and roll in the zone between the surface of the roll and the surface of the paper web facing the surface of the roll. The mist thus formed is marked 7 in FIG. 2.

Figure 3:
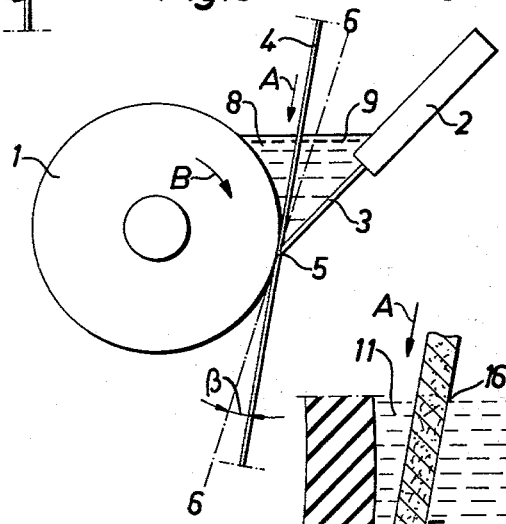
FIG. 3 shows the device illustrated in FIG. 1 as used in the modified process according to the invention.

In FIG. 3, the presently preferred mode of carrying out the process according to the invention, is shown in a device which in its main features corresponds to that in FIGS. 1 and 2. Again there is rotating applicator roll 1, a blade holder 2, the flexible blade 3 and a paper web 4, the contact point or nip between the plate and the applicator roll being marked 5 and the tangient through the contact point 5 marked 6—6.

The sump of coating agent which is formed on each side of the paper web 4 is marked 8 and 9 respectively. It has now been proved, surprisingly, that the mist formation at high web speeds and large amounts applied is completely eliminated if the angle, marked $\beta$ in FIG. 3, between the tangient 6—6 at the contact point 5 and the direction of running of the paper web is kept at less than 12° after the nip between the roll and blade.

It may be mentioned here as an example that, when coating a paper envisaged for printing purposes, it was possible to run this paper web at a speed of 850 m/minute and at the same time to provide a total amount applied of 22 g/m$^2$ in a uniform distribution on both sides of the paper web. In this case, the viscosity of the coating agent was 800 centipoises and the dry solids content was 56%. The angle $\beta$ of take-off was 10°.

In another case, the coating composition had a dry solids content of 60% and a viscosity of 1,000 centipoises. The speed of the paper web was 700 m/minute and the total amount applied was 20 g/m$^2$. In this case, the angle $\beta$ of take-off was 8°. A very good coating result was also obtained in this illustrative example.

With respect to the viscosity of the coating composition, the rule within the scope of the present invention is that this viscosity should be held between 400 and 2,000, preferably between 1,200 and 1,500 (according to Brookfield).

A further advantage of the process proposed according to the invention is that the danger of an orange-peel pattern could be completely eliminated with angles of take-off of 8°–12°.

It is quite difficult to find a fundamental explanation for the effect which leads to mist formation and also for the reason why this effect can be overcome according to the invention. A hypothesis has been put forward for this, even if it can be substantiated only partially.

Figure 4:
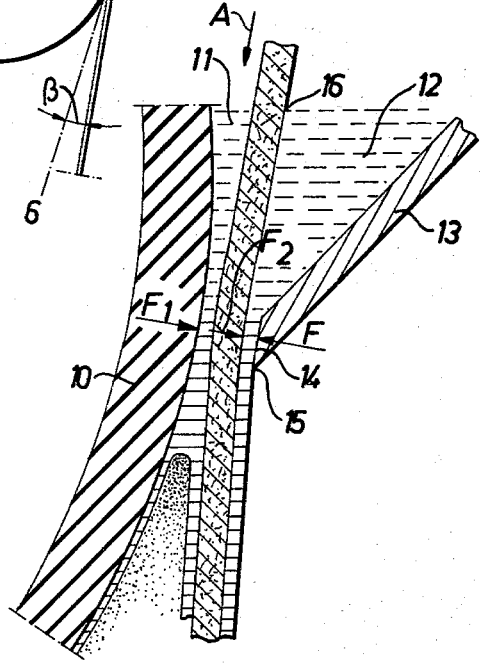
FIG. 4 is a partial enlargement of FIG. 3.

In this connection, reference is made to FIG. 4; the surface of the applicator roll corresponds to the roll surface according to FIG. 1 and has here been marked 10 in the zone of the nip between the roll and blade. The lower part of the sump 8 in FIG. 3 is marked 11 in FIG. 4, and the lower part of the corresponding sump 9 is marked 12. The lower part of the blade 3 is marked 13, the chamfer of the blade, facing the paper web, is marked 14 and the tip of the blade is marked 15. In the zone of the nip between the roll and blade, the paper web 4 is marked. When carrying out the process, the coating composition from the sump part 11 and 12 will form a spreading film within the zone of the nip between the roll and blade. As a result of the contact pressure of the lower part of the blade 13 in this zone, a force directed towards the roll is generated, and this is marked F in FIG. 4. A force in the opposite direction, marked $F_1$, applies along the surface 10 of the roll.

The take-off of the paper web from the roll over the blade edge 15 generates a force $F_2$ which has the same direction as the force $F_1$. Since in practice, when using the known billblade process, uniform distribution of the amount applied on both sides of the paper web is obtained at moderate web speeds or speeds of up to 400 m/minute, it can be assumed that in this case there is such an equilibrium condition in this nip between the blade and roll that the thickness of the film between the surface 10 of the roll and the paper web 5 and the blade chamfer 14 is approximately equal. At higher web speeds, however, an increased turbulence arises in the two sump parts 8 and 9 due to the higher speed of the paper web. It has been found that, at high speeds, the turbulence in the sump 8 increases considerably more than the turbulence in the sump 9. The reason for this fact is that two surfaces move in the sump 8, which both have the effect of pulling the coating composition down towards the contact point 5, namely in part the motion of the surface 10 of the roll and in part the motion of the paper web 16. It is assumed therefore that, at high speeds, the hydraulic pressure due to the motion of the coating composition rises to a greater extent in the lower part 11 of the sump 8 than in the lower part 12 of the sump 9. Presumably, the conditions in the nip between the blade and roll are then altered in such a way that the equilibrium is changed and the paper web 16 is pressed more closely against the blade surface by the higher hydraulic pressure between the surface 10 of the roll and the paper web 16. It can also be assumed that the hydraulic pressure rises with an increasing viscosity and correspondingly with an increasing dry solids content of the coating composition.

The end effect of this when coating at high web speeds would be a non-uniform distribution of the coating composition on both sides of the paper web. For example, it can be presumed that, with a total amount applied of 20 g/m$^2$—the amount applied being selected by an appropriate choice of the blade pressure—a risk-free distribution of 10 g/m$^2$ per side of the paper web is obtained at moderate speeds but, at higher speeds and with a chosen blade pressure appropriate to 20 g/m$^2$, the distribution obtained is, instead, about 13 g/m$^2$ on the roll side and 7 g/m$^2$ on the blade side of the paper web.

It is known from experience that an amount of 13 g/m$^2$ on the side of the paper web, facing the applicator roll, can under certain conditions result in a film split effect in the form of a so-called orange-peel pattern. The reason for this fact is that a part of the coating composition tends to run along with the roll when these relatively large amounts are applied. In this manner, the coating film is divided, in the manner of droplets formed, between the surface of the paper and the surface of the roll. At high speeds, such a film split effect could very probably lead to an extensive formation of droplets in the form of a mist.

If the angle of take-off of the paper web is now diminished, the force $F_2$ is also diminished, under otherwise the same conditions. As a result, the force $F_1$ will increase to the corresponding extent and, in this way, very largely re-establish the equilibrium in the system. If this diminution of angle is carried out under otherwise the same conditions, that is to say with inter alia an unchanged blade pressure, the total amount applied will fall below the desired amount of 20 g/m$^2$, as can be seen from the above example. As already said, the above aspects are only a hypothesis for explaining the surprising technical effect which is achieved when, at high web speeds, the angle of take-off is diminished to less than 12°.

In all the cases mentioned above, the expression total amount applied means the total amount, in g, of dry solids applied to both sides of the paper per m$^2$.

I claim:

1. A continuous process for applying a coating to both sides of a paper web, said process comprising the steps of:

(a) feeding the web at a speed of at least 400 meters per minute through the nip formed between a rotating applicator roll and an elastically yielding blade having an edge which urges the web towards the roll, whereby a first sump is formed between the paper web and the roll and a second sump is formed between the paper web and the blade;

(b) feeding a coating composition into each of said first and second sumps at a rate such that the amount of coating material applied to the web, calculated as the total of both sides of the web, exceeds 14 grams per square meter;

(c) maintaining the viscosity of the coating composition in said first and second sumps at 400 to 2000 centipoises; and (d) withdrawing the paper web from the nip, so that it is bent away from the applicator roll over the edge of the blade at an angle of between 8° to 12° to the tangient to the roll at the nip.

2. The continuous process for applying a coating to both sides of a paper web as claimed in claim 1 wherein said web is fed at a speed of at least 500 meters per minute.

3. A continuous process for applying a coating to both sides of a paper web as claimed in claims 1 or 2 wherein said viscosity is maintained at 1200 to 1500 centipoises.

4. A continuous process for applying a coating to both sides of a paper web as claimed in claim 3 wherein said coating composition is fed into each of said first and second sumps at a rate such that the amount of coating material applied to each side of the web is 10–12 grams per square meter.

5. A continuous process for applying a coating to both sides of a paper web as claimed in claim 1 wherein said web speed is 800 meters per minute, said coating composition is fed into each of said first and second sumps at a rate such that the amount of coating material applied is 22 grams per square meter, said viscosity is maintained at 800 centipoises and said angle is 10°.

6. A continuous process for applying a coating to both sides of a paper web as claimed in claim 1 wherein said speed is 700 meters per minute, said coating composition is fed to each of said first and second sumps such that the amount applied is 20 grams per square meter, said viscosity is 1000 centipoises and said angle is 8°.

* * * * *